US011203898B2

(12) United States Patent
Roberts et al.

(10) Patent No.: US 11,203,898 B2
(45) **Date of Patent: *Dec. 21, 2021**

(54) SECURITY SCREEN MOUNTING SYSTEM AND METHOD THEREFOR

(71) Applicants: Don Roberts, Tupelo, MS (US); James Wilford Roberts, Saltillo, MS (US)

(72) Inventors: Don Roberts, Tupelo, MS (US); James Wilford Roberts, Saltillo, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/036,503

(22) Filed: Sep. 29, 2020

(65) Prior Publication Data

US 2021/0010325 A1 Jan. 14, 2021

Related U.S. Application Data

(63) Continuation-in-part of application No. 15/833,675, filed on Dec. 6, 2017, now Pat. No. 10,837,228.

(51) Int. Cl.

| | |
|---|---|
| ***E06B 9/52*** | (2006.01) |
| *E06B 9/24* | (2006.01) |
| *E06B 9/04* | (2006.01) |

(52) U.S. Cl.

CPC ..... *E06B 9/52* (2013.01); *E06B 9/04* (2013.01); *E06B 9/24* (2013.01); *E06B 2009/527* (2013.01)

(58) Field of Classification Search

CPC ..... E06B 9/04; E06B 9/52; E06B 9/24; E06B 2009/527; E06B 1/26

See application file for complete search history.

(56) References Cited

U.S. PATENT DOCUMENTS

| | | | | |
|---|---|---|---|---|
| 4,363,350 | A * | 12/1982 | Beckerer | B63B 19/02 160/92 |
| 5,038,537 | A * | 8/1991 | Frambach | E06B 3/325 52/207 |
| 5,666,773 | A * | 9/1997 | Librande | E05D 15/22 52/202 |
| 2002/0148168 | A1* | 10/2002 | Lilie | E06B 9/04 49/504 |
| 2004/0035082 | A1* | 2/2004 | Hudoba | E06B 9/02 52/656.7 |
| 2008/0302490 | A1* | 12/2008 | Wilson | E06B 9/52 160/371 |
| 2009/0173462 | A1* | 7/2009 | Elfers | E06B 9/52 160/371 |
| 2015/0284994 | A1* | 10/2015 | Richter | E06B 9/02 160/92 |

FOREIGN PATENT DOCUMENTS

| | | | | |
|---|---|---|---|---|
| WO | WO-03076741 | A1 * | 9/2003 | E06B 5/025 |

* cited by examiner

*Primary Examiner* — Marcus Menezes
(74) *Attorney, Agent, or Firm* — Kenneth & Barnes

(57) ABSTRACT

A mounting system and method for security screens for use with double-hung windows and other windows having an integral screen track is disclosed. The mounting system and method according to the present invention reduces materials cost for manufacture of security screens while improving aesthetics of the installation, and permits installation of security screens either at the construction site or during window manufacture, while preserving the window manufacturer's warranty.

13 Claims, 7 Drawing Sheets

SECURITY SCREEN MOUNTING SYSTEM AND METHOD THEREFOR

CROSS-REFERENCE TO RELATED APPLICATION

This application is a continuation-in-part of U.S. patent application Ser. No. 15/833,675, filed Dec. 6, 2017.

BACKGROUND OF THE INVENTION

Security screens are a popular option to protect windows of businesses and homes from unauthorized intrusion such as burglars breaking the window to gain access, hail or other weather conditions, and other types of damage. Many commonly installed windows are made from materials such as "vinyl" (poly vinyl chloride, or PVC) or fiberglass that due to their relative strength in comparison to materials such as aluminum or wood, are not suitable for using mechanical fasteners such as screws to attach the security screen directly to the window. Also, direct attachment to the window itself, regardless of the material the window is made from, would cause damage such as punctures that could produce leaks and could void the window manufacturer's warranty. Consequently, existing systems and methods for installing security screens attach the screens to the exterior wall surrounding the window opening, either directly, or using spacers to build out around the window to provide clearance for the installation of the screen in circumstances where the window has not been installed recessed or flush relative to the wall surface. Security screens attached to the wall surrounding the window opening must thus be as large as, or often larger, than the window they are to protect, which is both aesthetically undesirable and increases manufacturing cost for the screens due to increasing the amount of materials required for their construction. A need therefore exists for a security screen mounting system and method which will not cause damage to the window that could void the window manufacturer's warranty, reduces manufacturing cost for the security screen, and improves the aesthetics of the installed screens by not hiding the window entirely behind an oversized security screen.

REFERENCE NUMBERS

160 Window frame
162 Header
164 Left jamb
166 Right jamb
168 Sill
170 Screen track
200 Security screen (top hinged)
240 Screen frame
242 Screen
244 Screen retaining strip
246 Weatherstripping
260 Hinge
280 Latch
300 Security screen (center hinged)
320 Screen panels
322 Fixed screen panel
324 Working screen panel
340 Connecting hinge
400 Mounting rail
410 Mounting rail (header)
412 Rail (sill)
420 Fasteners

DETAILED DESCRIPTION OF THE DRAWINGS

Figure 1:
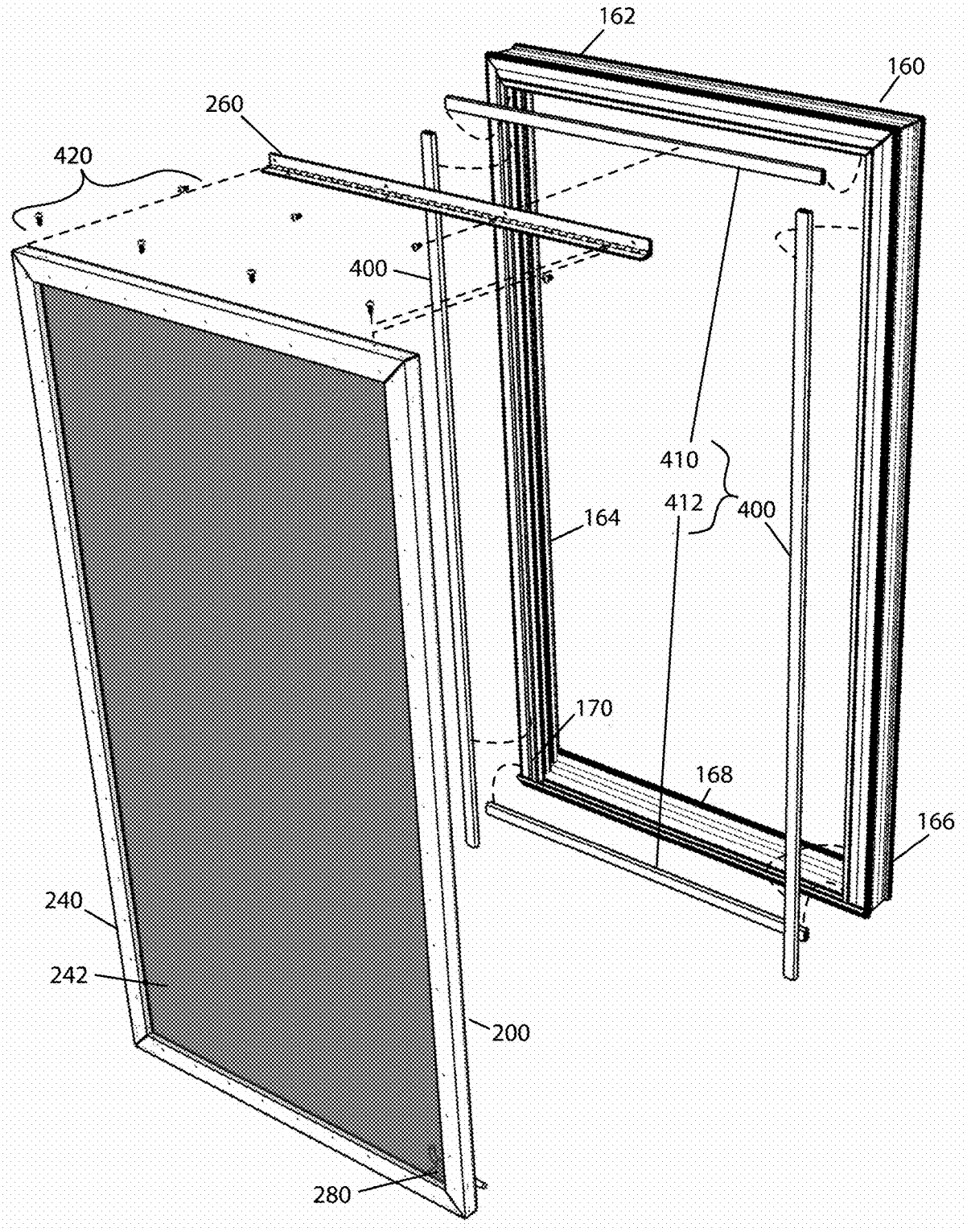
FIG. 1 is an exploded oblique front elevation view of a hinged security screen in closed position illustrating a mounting method according to an embodiment of the invention.

FIG. 1 is an exploded oblique front elevation view of a hinged security screen in closed position illustrating a mounting method according to an embodiment of the invention. For windows having an integral screen track 170 as part of the exterior portion of the window frame 160, which would include most double-hung windows, a security screen 200 can be sized to fit between the integral screen track 170 of the left jamb 164 and the integral screen track 170 of the right jamb 166. A plurality of mounting rails 400, sized and configured to fit within the integral screen track 170 of the window frame 160 are inserted in the integral screen track 170 and sized to the lengths of portions of the integral screen track 170, such as the lengths of the integral screen track 170 of the left jamb 164, the integral screen track 170 of the right jamb 166, and the integral screen track 170 of the header 162.

The lengths of the mounting rails 400 inserted in the integral screen track 170 of the left jamb 164 and the integral screen track 170 of the right jamb 166 may be shortened to accommodate the width of the mounting rail 410 inserted into the integral screen track 170 of the header 162, so that the ends of the mounting rail 410 inserted into the integral screen track 170 of the header 162 rest atop the mounting rails 400 inserted in the integral screen track 170 of the left jamb 164 and the integral screen track 170 of the right jamb 166. A hinge 260, or other pivoting attachment means, connects the security screen 200 to the mounting rail 410 inserted into the integral screen track 170 of the header 162. The hinge 260 is attached to the screen frame 240 and the mounting rail 410 inserted into the integral screen track 170 of the header 162 using fasteners 420, such as screws, and in a preferred embodiment the screws are self-tapping screws which are inserted into pre-drilled holes in the leaves of the hinge and driven into the mounting rail 410 inserted into the integral screen track 170 of the header 162 and the top of the screen frame 240. In a preferred embodiment, the thickness of the mounting rail 410 inserted in the header 162 may be reduced to compensate for the thickness of one of the leaves of the hinge 260, permitting one leaf of the hinge to be inserted into the integral screen track 170 of the header 162 along with and adjacent to the mounting rail 410 inserted in the integral screen track of the header 162.

Optionally, the lengths of the mounting rails 400 inserted in the integral screen track 170 of the left jamb 164 and the integral screen track 170 of the right jamb 166 may be shortened further to accommodate a rail 412 whose ends are inserted beneath the mounting rails 400 inserted in the integral screen track 170 of the left jamb 164 and the integral screen track 170 of the right jamb 166, and spanning between them across the sill 168.

During installation, the optional sill rail 412 may first be positioned by inserting its ends into the bottom portion of the integral screen track 170 of the left jamb 164 and the integral screen track 170 of the right jamb 166. Next, or if no sill rail 412 is used, the header mounting rail 410 is inserted into the integral screen track 170 of the header 162. In a preferred embodiment, the hinge 260 is pre-attached to the header mounting rail 410, and the security screen 200 is attached to the hinge 260 following installation of the remaining mounting rails 400 inserted into the integral screen track 170 of the window frame 160. The header mounting rail 410 is held in place as mounting rails 400 are then inserted into the integral screen tracks 170 of the left jamb 164 and the right jamb 166, completing the installation of the plurality of mounting rails 400. It should be understood that the optional sill rail 412, if used, may be installed either before or after the header mounting rail 410, and that the mounting rails 400 inserted into the integral screen track 170 of the left jamb 164 and the integral screen track of the right jamb 166 may installed in either order, but that the mounting rails 400 inserted into the integral screen track 170 of the left jamb 164 and the integral screen track of the right jamb 166 must be installed last, following installation of the header mounting rail 410 and the sill rail 412, if used.

In a preferred embodiment, each of the plurality of mounting rails 400 have a width greater than the depth of the integral screen track 170 into which they are inserted (see also cross section in FIG. 4), and extend inwardly from the integral screen track 170 of the window frame, providing a stop against which the screen frame 240 can rest when closed. This additional width of the mounting rails 400 also makes installation easier by providing exposed handholds and a raised surface to tap against, and structurally strengthens the mounting rails to support the weight of the security screen 200. The plurality of mounting rails 400 inserted in the integral screen track 170 of the window frame 160 are not attached to the window frame 160, but are held in place by friction due to the close fit of the plurality of mounting rails 400 relative to the integral screen track 170 into which they are inserted, and their close fit relative to each other. If desired, a bead of construction adhesive may be applied to the plurality of mounting rails prior to installation in the integral screen track to further strengthen the installation. For clarity of illustration, only the window frame 160 is illustrated, and the sashes of the window being protected are not shown.

It should be understood that a further embodiment of the mounting method of the invention in which a hinge 260 is inserted along with and adjacent to one of the mounting rails 400 in the integral screen track 170 of the left jamb 164 or the right jamb 166 is possible, with the plurality of mounting rails 400 installed in the integral screen track 170 of the window frame 160 in the same lengths and configuration as is used with the embodiment of the mounting method of the invention shown in FIGS. 1-4, except that the thinner mounting rail 410 is used for the mounting rail inserted into the integral screen track of the jamb where the hinge 260 is to be installed.

Figure 2:
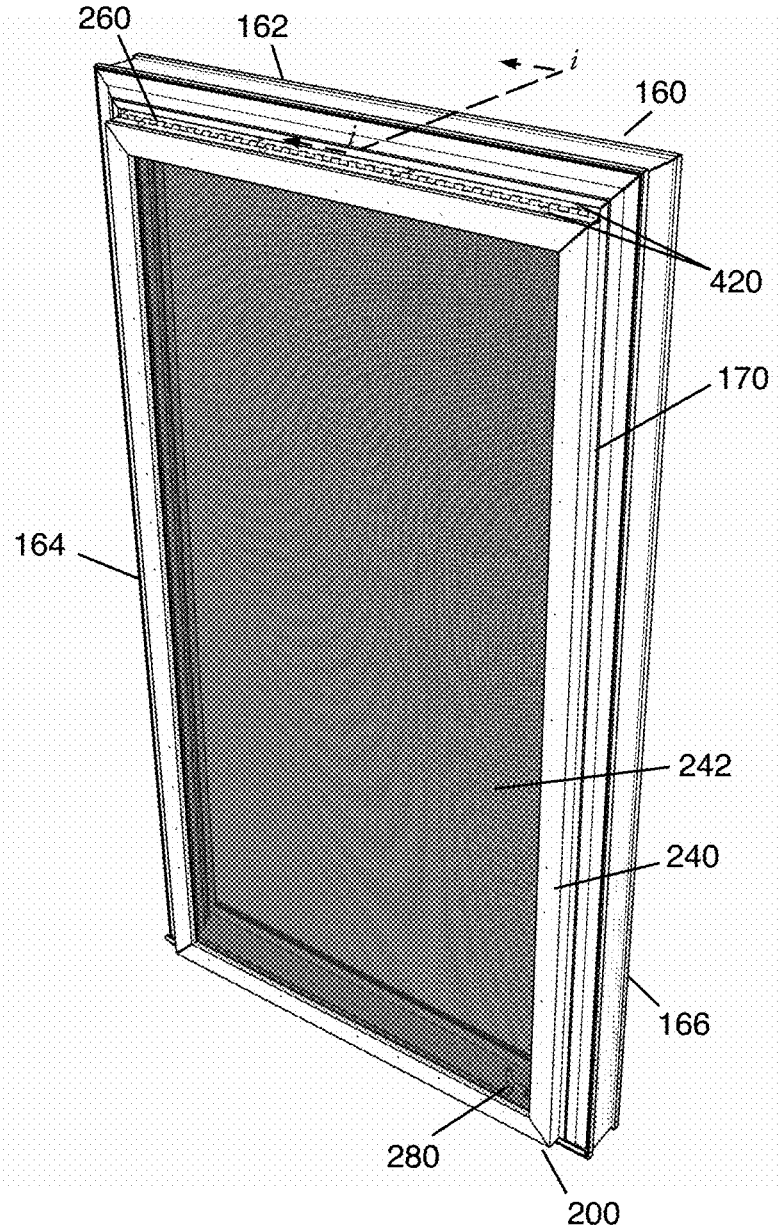
FIG. 2 is an assembled oblique front elevation view of a hinged security screen in closed position illustrating a mounting method according to an embodiment of the invention.

FIG. 2 is an assembled oblique front elevation view of a hinged security screen in closed position illustrating a mounting method according to an embodiment of the invention. For windows having an integral screen track 170 as part of the exterior portion of the window frame 160, which would include most double-hung windows, a security screen 200 can be sized to fit between the integral screen track 170 in the left jamb 164 and the integral screen track 170 in the right jamb 166. The security screen 200 according to the present invention is thus smaller in size than prior art security screens relative to the window to be protected and the mounting method according to the present invention does not require a mounting flange, reducing materials requirements for construction and manufacture of the security screen 200. In a preferred embodiment, the thickness of the mounting rail 410 inserted in the header 162 may be reduced to compensate for the thickness of one of the leaves of the hinge 260, permitting one leaf of the hinge to be inserted into the integral screen track 170 of the header 162 along with and adjacent to the mounting rail 410 inserted in the integral screen track of the header 162. In a preferred embodiment, the hinge 260 is pre-attached to the header mounting rail 410, and the security screen 200 is attached to the hinge 260 following installation of the remaining mounting rails 400 inserted in the integral screen track 170 of the window frame 160.

Provided that a window has the necessary integral screen track, installation of security screens on windows according to the method of the present invention may be done in the field after window installation, or alternatively can be done at the factory during window manufacture. Installation of security screens at the factory during window manufacture is another advantage of the present invention, and can greatly simplify installation at the construction site when compared to installing windows and security screens as separate steps. Unlike other embodiments of the mounting system of the invention, the hinged-at-the-top version is not readily installed from the interior side of the window, due to a lack of access to the hinge fasteners 420 from the interior side. For clarity of illustration, only the window frame 160 is illustrated, and the sashes of the window being protected are not shown.

Figure 3:
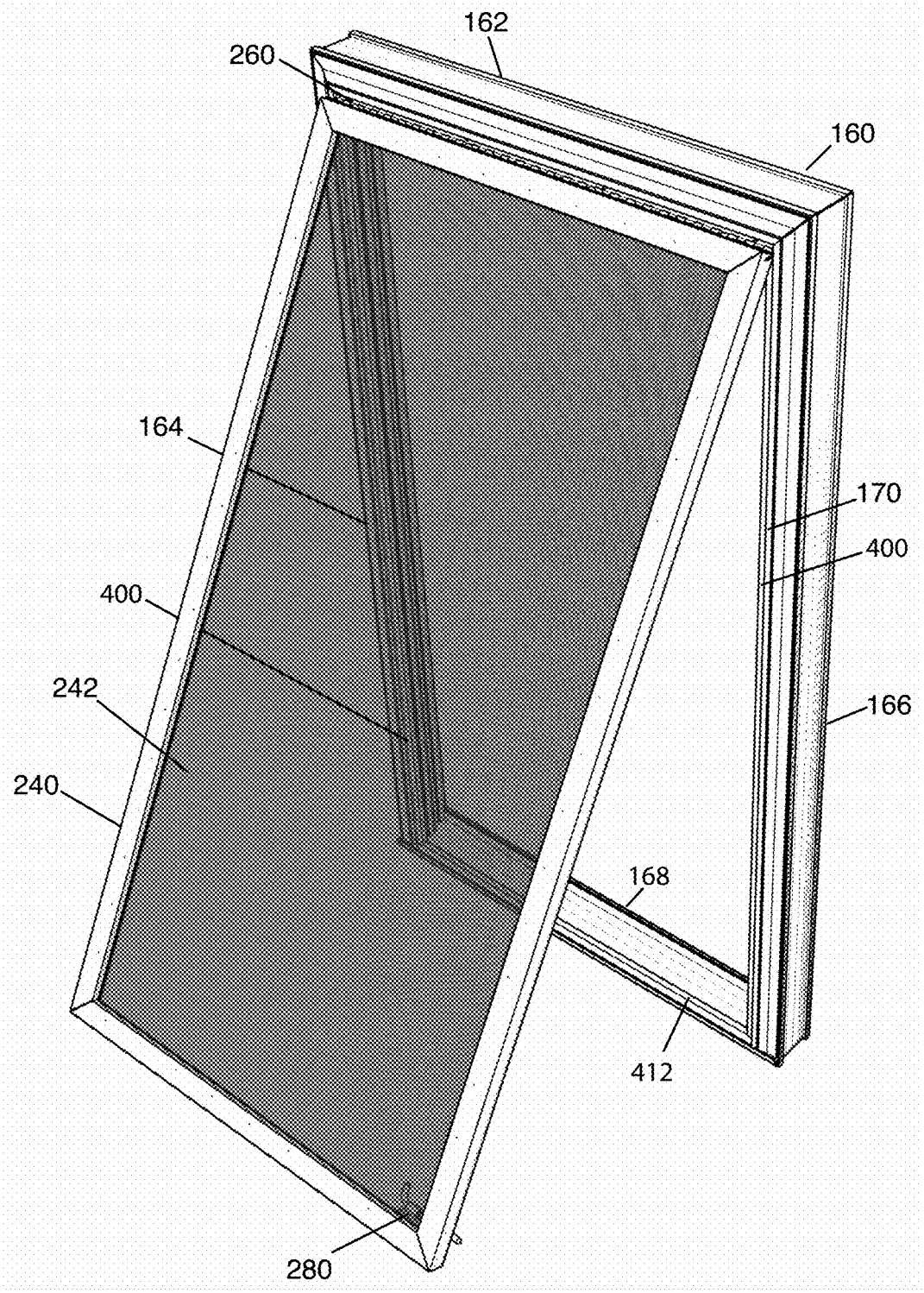
FIG. 3 is an assembled oblique front elevation view of a hinged security screen in open position illustrating a mounting method according to an embodiment of the invention.

FIG. 3 is an assembled oblique front elevation view of a hinged security screen in open position illustrating a mounting method according to an embodiment of the invention. A top hinge 260 or other pivoting attachment means enables the security screen 300 to be pivoted open in the event access or egress through the window is needed, such as during an emergency. The mounting rails 400 may be made of any suitable rigid material, such as metal, wood, polymer or composite materials, and in a preferred embodiment are metal tubing having a substantially rectangular cross section, such as aluminum tubing. In a preferred embodiment, each of the plurality of mounting rails 400 have a width greater than the depth of the integral screen track 170 into which they are inserted (see also cross section in FIG D), and extend inwardly from the integral screen track 170 of the window frame, providing a stop against which the screen frame 240 can rest when closed. This additional width of the mounting rails 400 also makes installation easier by providing exposed handholds and a raised surface to tap against, and structurally strengthens the mounting rails to support the weight of the screen 200. Although four-sided hollow rectangular tubing is shown as the mounting rails 400, "U"-channel or solid bar stock may also be used, and bolts or machine screws could be used for the fasteners 420, attaching the hinge 260 to a header mounting rail 410 or screen frame 240 having threaded holes. In a preferred embodiment, most of the visible parts, including the security screen panel 200, screen 242, hinge 260, and mounting rails 400 are powder-coated for appearance and durability. A latching means, such as a barrel bolt 280, or a single point latch as disclosed in U.S. Pat. No. 6,176,041, located at the side of the security screen 200 opposite to the hinge 260 or other pivotable mounting means, may be used to reversibly secure the security screen 200 to the window frame 160 to prevent opening the security screen 200 until released from the interior side of the window. For clarity of illustration, only the window frame 160 is illustrated, and the sashes of the window being protected are not shown.

Figure 4:
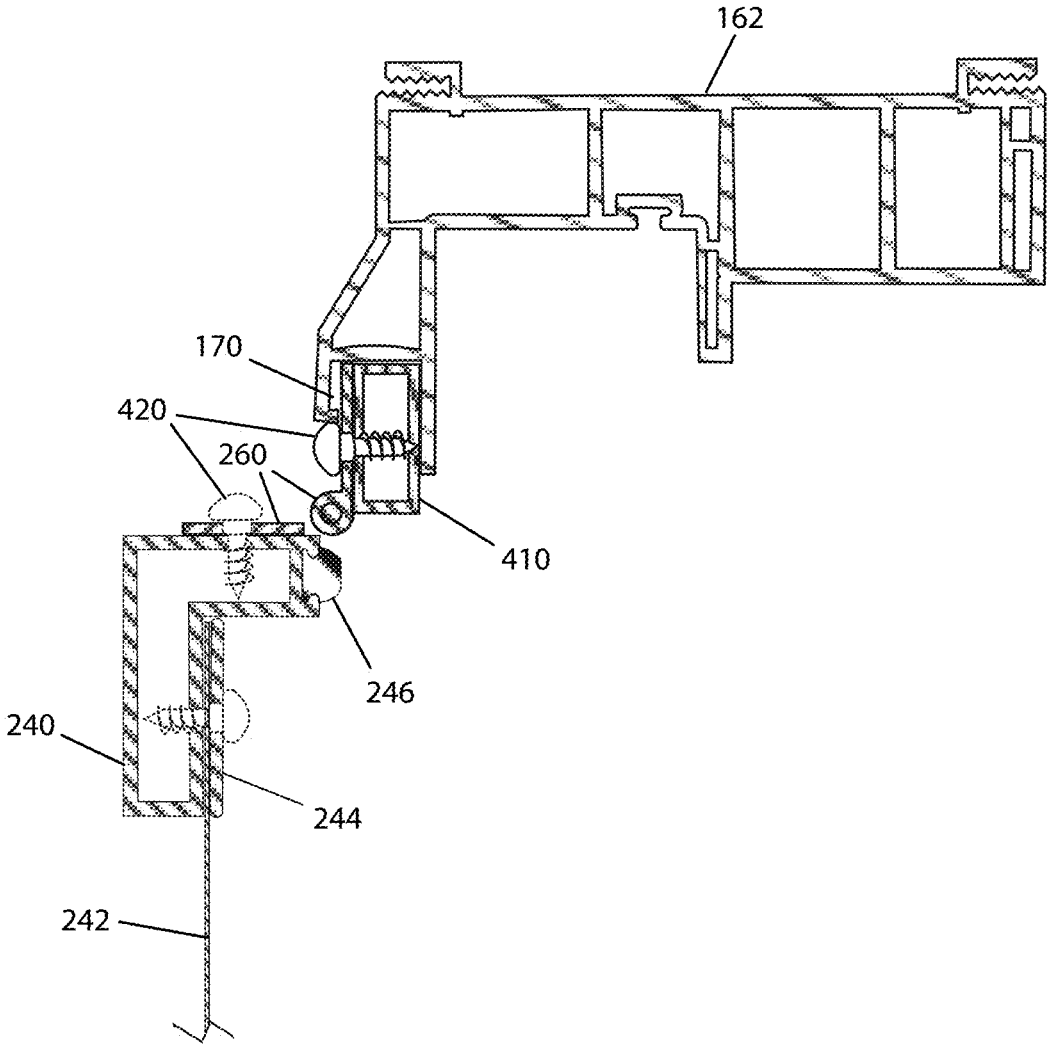
FIG. 4 is an assembled cross-sectional elevation view of the hinged security screen of FIG. 2 sectioned along line i-i and illustrating a mounting method according to an embodiment of the invention.

FIG. 4 is an assembled cross-sectional elevation view of the hinged security screen of FIG. 2 sectioned along line i-i and illustrating a mounting method according to an embodiment of the invention. In an exemplary embodiment, the security screen 200 is pivotably mounted to the header mounting rail 410 by a hinge 260, or other pivoting attachment means. This allows the security screen 200 to be pivoted open in the event access or egress through the window is needed, such as during an emergency. In a preferred embodiment, the screen frame 240 is made of metal, such as extruded aluminum, and the hinge is a steel piano hinge. In a preferred embodiment, the thickness of the mounting rail 410 inserted in the header 162 may be reduced to compensate for the thickness of one of the leaves of the hinge 260, permitting one leaf of the hinge to be inserted into the integral screen track 170 of the header 162 along with and adjacent to the mounting rail 410 inserted in the integral screen track of the header 162. In a preferred embodiment the screws are self-tapping screws which are inserted into pre-drilled holes in the leaves of the hinge and driven into the top of the screen frame 240 and the mounting rail 410 inserted into the integral screen track 170 of the header 162. As known in the art, screen retaining strips 244 may be used to attach the screen 242 to the screen frame 240, and the screen frame 240 may include weatherstripping 246 on the side contacting the plurality of mounting rails 400. In a preferred embodiment, most of the visible parts, including the security screen panel 200, screen 242, hinge 260, and mounting rails 400 are powder-coated for appearance and durability. For clarity of illustration, only the window frame 160 is illustrated, and the sashes of the window being protected are not shown.

Figure 5:
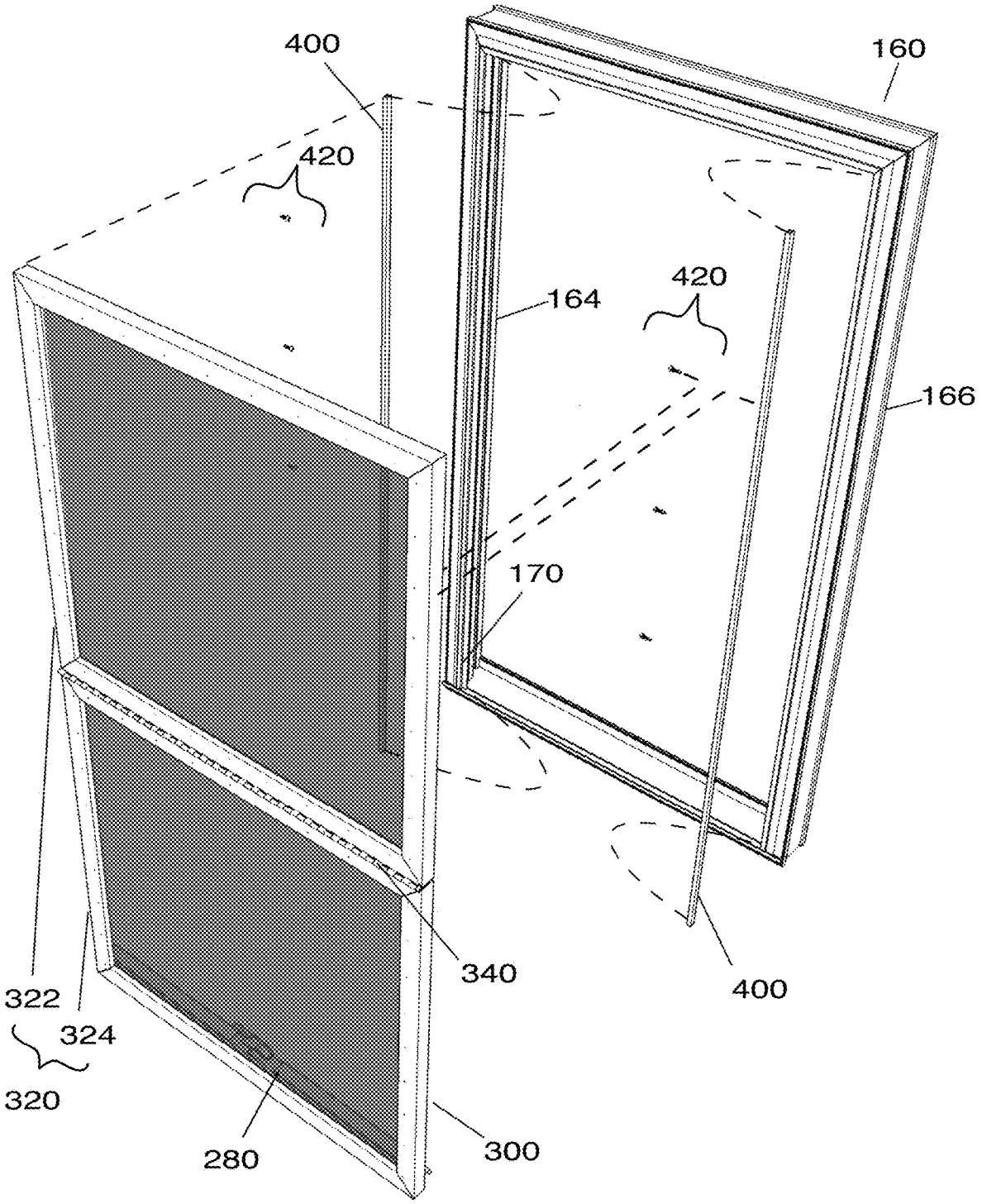
FIG. 5 is an exploded oblique front elevation view of a hinged security screen in closed position illustrating a mounting method according to an embodiment of the invention.

FIG. 5 is an exploded oblique front elevation view of a hinged security screen in closed position illustrating a mounting method according to an embodiment of the invention. For windows having an integral screen track 170 as part of the exterior portion of the window frame 160, which would include most double-hung windows, a security screen 300 having a connecting hinge 340 can be sized to fit between the integral screen track 170 in the left jamb 164 and the integral screen track 170 in the right jamb 166. The security screen 300 may consist of a plurality of screen panels 320 dividing the space between the opposing sides of the integral screen track 170, the plurality of screen panels 320 joined by at least one connecting hinge 340. In an exemplary embodiment, as shown, two screen panels 320 are joined by a horizontal connecting hinge 340. A plurality of mounting rails 400, sized and configured to fit within the integral screen track 170 of the window frame 160 are inserted in the integral screen track 170 and sized to the length of a portion of the integral screen track 170, such as the length of the integral screen track 170 of the left jamb 164 and the integral screen track 170 of the right jamb 166. A fixed screen panel 322 is attached to the plurality of mounting rails 400 using fasteners 420, such as screws, and in an preferred embodiment the screws are self-tapping screws which are inserted into pre-drilled holes in the fixed screen panel 322 and driven into the mounting rails 400. A working screen panel 324 is pivotably mounted to the fixed screen panel 322 by a connecting hinge 340, or other pivoting attachment means. This allows the working screen panel 324 of the security screen 300 to be pivoted open in the event access or egress through the window is needed, such as during an emergency. For clarity of illustration, only the window frame 160 is illustrated, and the sashes of the window being protected are not shown.

Figure 6:
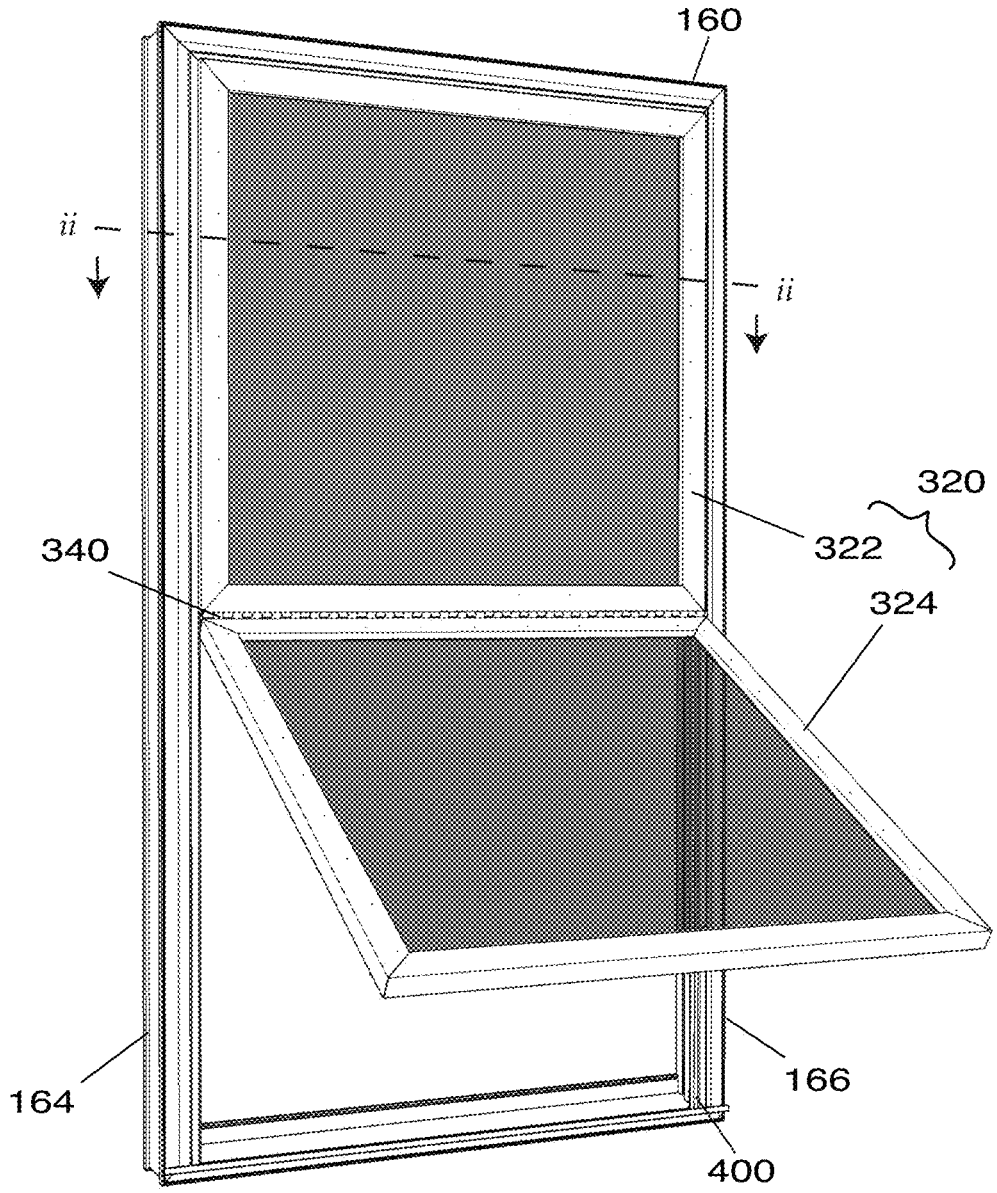
FIG. 6 is an assembled oblique front elevation view of a hinged security screen in open position illustrating a mounting method according to an embodiment of the invention.

FIG. 6 is an assembled oblique front elevation view of a hinged security screen in open position illustrating a mounting method according to an embodiment of the invention. According to an embodiment of the invention, for windows having an integral screen track 170 as part of the exterior portion of the window frame 160, which would include most double-hung windows, a security screen 300 having a connecting hinge 340 can be sized to fit between the integral screen track 170 in the left jamb 164 and the integral screen track 170 in the right jamb 166. In an exemplary embodiment, as shown, two screen panels 320 are joined by a horizontal connecting hinge 340. A plurality of mounting rails 400, sized and configured to fit within the integral screen track 170 of the window frame 160 are inserted in the integral screen track 170 and sized to the length of a portion of the integral screen track 170, such as the length of the integral screen track 170 of the left jamb 164 and the integral screen track 170 of the right jamb 166. A fixed screen panel 322 is attached to the plurality of mounting rails 400 using fasteners 420, such as screws, and in a preferred embodiment the screws are self-tapping screws which are inserted into predrilled holes in the fixed screen panel 322 and driven into the mounting rails 400. A working screen panel 324 is pivotably mounted to the fixed screen panel 322 by a connecting hinge 340, or other pivoting attachment means. The mounting rails 400 may be made of any suitable rigid material, such as metal, wood, polymer or composite materials, and in a preferred embodiment are metal tubing having a substantially rectangular cross section, such as aluminum tubing. Although four-sided hollow rectangular tubing is shown as the mounting rails 400, "U"-channel or solid bar stock may also be used, and bolts or machine screws could be used for the fasteners 420 attaching the fixed screen panel 322 to mounting rails 400 having threaded holes. In the exemplary embodiment shown, the mounting rails 400 run the full lengths of the integral screen track 170 of the left jamb 164 and the integral screen track 170 of the right jamb 166, supporting the fixed screen panel 322 and preventing it from sliding downward along with the mounting rails 400, which it might do if the mounting rails 400 were shorter, or only the same length as the sides of the fixed screen panel 322. A latching means, such as a latch 280 or barrel bolt, located at the side of the working screen panel 324 opposite to the connecting hinge 340 or other pivotable mounting means, may be used to reversibly secure the working screen panel 324 to the window frame 160 to prevent opening the working screen panel 324 until released from the interior side of the window. In a preferred embodiment, the latch 280 is a single-point latch as disclosed in U.S. Pat. No. 6,176,041. For clarity of illustration, only the window frame 160 is illustrated, and the sashes of the window being protected are not shown.

Figure 7:
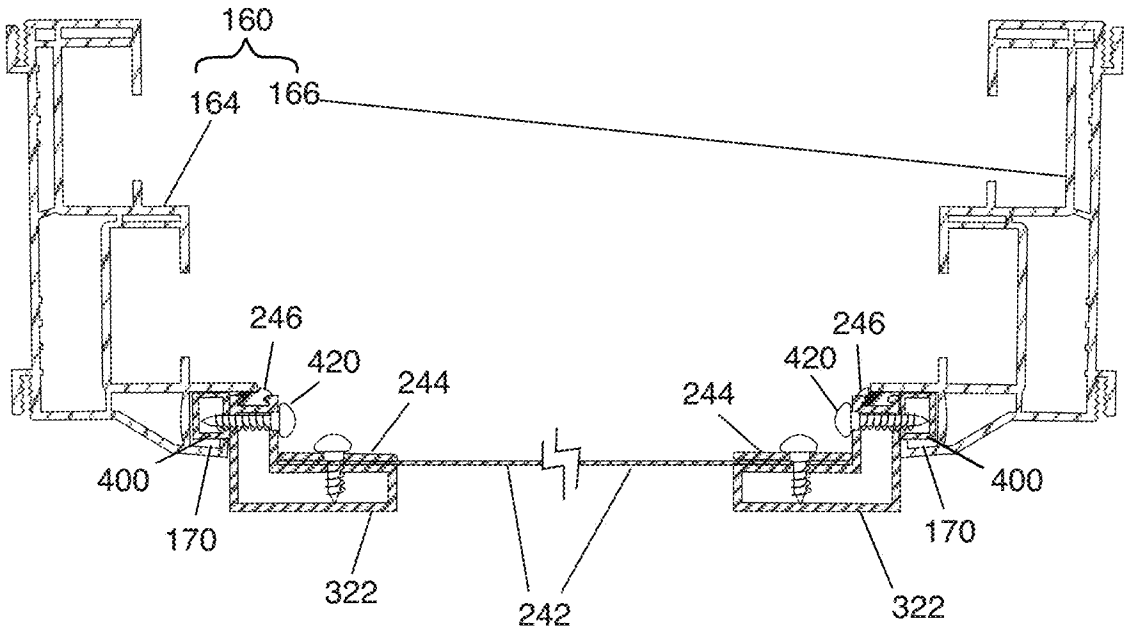
FIG. 7 is an assembled cross-sectional plan view of the hinged security screen of FIG. 6 sectioned along line ii-ii and illustrating a mounting method according to an embodiment of the invention.

FIG. 7 is an assembled cross-sectional plan view of the hinged security screen of FIG. 6 sectioned along line ii-ii and illustrating a mounting method according to an embodiment of the invention. The fixed screen panel 322 of this embodiment is attached directly to the mounting rails 400 using fasteners 420, such as screws, and in a preferred embodiment the screws are self-tapping screws which are inserted into pre-drilled holes in the fixed screen panel 322 and driven into the mounting rails 400. In a preferred embodiment, the screen panels 320 are made of metal, such as extruded aluminum, and the connecting hinge is a steel piano hinge. As known in the art, screen retaining strips 244 may be used to attach the screen 242 to the screen panels 320, and the screen panels may include weatherstripping 246 on the side contacting the window frame 160. In a preferred embodiment, most of the visible parts, including the screen panels 320, screen connecting hinge 340, and screen 242 are powder-coated for appearance and durability.

We claim:

1. A system for mounting a security screen to a window frame, wherein said window frame has frame members consisting of a header, a left jamb, a right jamb, and a sill; said window frame having in an exterior portion of each of at least the left and right jambs a U-shaped integral screen track having a depth; the system comprising a security screen, a plurality of mounting rails configured to fit within said integral screen track, each of said plurality of mounting rails having a width configured to be greater than the depth of said integral screen track, and an attachment means to attach said security screen to at least one of said plurality of mounting rails.

2. The system of claim 1, wherein at least two of the said plurality of mounting rails are opposingly disposed within said integral screen track of the left and right jambs of said window frame.

3. The system of claim 2, further comprising at least one mounting rail disposed within said integral screen track of the header of said window frame.

4. The system of claim 3, wherein the attachment means to attach said security screen to said at least one of said plurality of mounting rails comprises a pivotable mounting means.

5. The system of claim 4, wherein said pivotable mounting means comprises a hinge and screws attaching said hinge to said security screen and to said at least one of said plurality of mounting rails within said integral screen track of the header of said window frame.

6. The system of claim 5, wherein the ends of said at least one of said plurality of mounting rails disposed within said integral screen track of the header of said window frame extend into said integral screen track of the left and right jambs of said window frame, and are positioned above and supported by said mounting rails opposingly disposed within said integral screen track of the left and right jambs of said window frame.

7. The system of claim 3, wherein the ends of said at least one of said plurality of mounting rails disposed within said integral screen track of the header of said window frame extend into said integral screen track of the left and right jambs of said window frame, and are positioned above and supported by said mounting rails opposingly disposed within said integral screen track of the left and right jambs of said window frame.

8. The system of claim 6, wherein said hinge comprises two leaves, and said at least one of said plurality of mounting rails disposed within said integral screen track of the header of said window frame is configured to permit one leaf of said hinge to be disposed within said integral screen track of the header of said window frame along with and adjacent to said at least one of said plurality of mounting rails disposed within said integral screen track of the header of said window frame.

9. The system of claim 8, wherein the plurality of mounting rails further comprises a rail disposed across the sill of said window frame, the ends of said rail extending into said integral screen track of the left and right jambs of said window frame, and positioned below and supporting said at least two of said plurality of mounting rails opposingly disposed within said integral screen track of the left and right jambs of said window frame.

10. The system of claim 4, wherein the pivotable mounting means comprises a hinge and bolts attaching said hinge to said security screen and to said at least one of said plurality of mounting rails disposed within said integral screen track of the header of said window frame, said security screen and said at least one of said plurality of mounting rails disposed within said integral screen track of the header of said window frame each further comprising at least one threaded hole for receiving said bolts.

11. The system of claim 9, wherein the security screen further comprises a latching means configured to reversibly secure said security screen to said window frame.

12. A system for mounting a security screen to a window frame, wherein said window frame has frame members consisting of a header, a left jamb, a right jamb, and a sill; said window frame having in an exterior portion of each of at least the left and right jambs and the header a U-shaped integral screen track having a depth; the system comprising a security screen, a plurality of mounting rails configured to fit within said integral screen track, each of said plurality of mounting rails having a width configured to be greater than the depth of said integral screen track, and wherein at least one of said plurality of mounting rails is disposed within said integral screen track of the header of said window frame and extends into said integral screen track of the left and right jambs of said window frame, and at least two of the said plurality of mounting rails are opposingly disposed within said integral screen track of the left and right jambs of said window frame and positioned below and supporting the ends of said at least one of said plurality of mounting rails disposed within said integral screen track of the header of said window frame, and an attachment means to attach said security screen to at least one of said plurality of mounting rails.

13. The system of claim 12, wherein the attachment means to attach said security screen to said at least one of said plurality of mounting rails comprises a hinge and screws attaching said hinge to said security screen and to said at least one of said plurality of mounting rails disposed within said integral screen track of the header of said window frame, said hinge comprising two leaves, and said at least one of said plurality of mounting rails disposed within said integral screen track of the header of said window frame is configured to permit one leaf of said hinge to be disposed within said integral screen track of the header of said window frame along with and adjacent to said at least one of said plurality of mounting rails disposed within said integral screen track of the header of said window frame, and wherein the security screen further comprises a latching means configured to reversibly secure said security screen to said window frame.

* * * * *